US005534846A

United States Patent [19]

Kuroda

[11] Patent Number: 5,534,846

[45] Date of Patent: Jul. 9, 1996

[54] VEHICLE DOOR LOCK DEVICE WITH SUPER LOCK MECHANISM

[75] Inventor: Katsuya Kuroda, Yamanashi-ken, Japan

[73] Assignee: Mitsui Kinzoku Kogyo Kabushiki Kaisha, Tokyo, Japan

[21] Appl. No.: 380,326

[22] Filed: Jan. 30, 1995

Related U.S. Application Data

[63] Continuation of Ser. No. 91,288, Jul. 15, 1993, abandoned.

[30] Foreign Application Priority Data

| | | | |
|---|---|---|---|
| Jul. 17, 1992 | [JP] | Japan | 4-213440 |
| Sep. 21, 1992 | [JP] | Japan | 4-276651 |
| Sep. 29, 1992 | [JP] | Japan | 4-283878 |

[51] Int. Cl.[6] ..... B60R 25/10

[52] U.S. Cl. ..... 340/426; 180/287; 70/264; 292/201; 292/336.3; 307/10.2

[58] Field of Search ..... 340/426, 428, 340/430; 180/287; 307/10.2, 10.1; 70/1.5, 57.1, 237, 239, 264; 292/201, DIG. 23, 336.3

[56] References Cited

U.S. PATENT DOCUMENTS

| | | | |
|---|---|---|---|
| 3,693,150 | 9/1972 | Daniels | 340/426 |
| 4,628,300 | 12/1986 | Amato | 340/426 |
| 4,638,292 | 1/1987 | Mochida et al. | 340/426 |
| 4,727,301 | 2/1988 | Fulks et al. | 292/DIG. 23 |
| 4,887,065 | 12/1989 | Robitschko et al. | 340/426 |
| 4,933,664 | 6/1990 | Igawa et al. | 340/430 |
| 4,991,891 | 2/1991 | Karshens | 340/426 |
| 4,996,514 | 2/1991 | Sunami | 340/426 |
| 5,029,915 | 7/1991 | Wilkes | 292/336.3 |
| 5,037,145 | 8/1991 | Wilkes | 292/336.3 |
| 5,054,300 | 10/1991 | Nakahara et al. | 70/264 |
| 5,128,649 | 7/1992 | Elmer | 340/426 |
| 5,236,234 | 8/1993 | Norman | 292/201 |
| 5,247,279 | 9/1993 | Sato | 340/426 |
| 5,248,898 | 9/1993 | Périou | 307/10.2 |
| 5,409,277 | 4/1995 | Rogers, Jr. et al. | 292/336.3 |

FOREIGN PATENT DOCUMENTS 2227049 7/1990 United Kingdom .

*Primary Examiner*—Brent A. Swarthout
*Attorney, Agent, or Firm*—Browdy and Neimark

[57] ABSTRACT

A lock device has a lock lever changing from its locked position to its unlocked position by a normal-lock-motor, and a super lock member displaced between its super locked position preventing the lock lever from changing and a releasing position enabling the change. The lock device has a switch adapted to turn on when a key is inserted into the ignition key cylinder at the driver's seat, another switch adapted to turn on when any person is in the interior of a car, still another switch adapted to turn on when any door opens, still another switch adapted to turn on when the trunk opens, and still another switch adapted to turn on when any window opens. When even one of these switches has turned on and the super lock member is changed to its super locked position, an alarm buzzer sounds or the change to the super lock halts.

12 Claims, 14 Drawing Sheets

39
46
42
40
41
38
48
56
49
51
52
50
54
53
43
58
36
22
21
45
47
26
25
35
44
19
55
34
20
33
29
28
24
18
31
27
17
23
32
67
16
64
65
66
62
63

VEHICLE DOOR LOCK DEVICE WITH SUPER LOCK MECHANISM

This application is a continuation of application Ser. No. 08/091,288, filed Jul. 15, 1993, now abandoned.

BACKGROUND OF THE INVENTION

1. Industrial Field of the Invention

The present invention relates to a vehicle door lock device with a super lock mechanism. The super lock mechanism means a mechanism making mechanically a lock lever, exchanging a lock device between its locked condition and a unlocked or unlockable condition, undisplacable or unrotatable, expecting to prevent a crime from occurring.

2. Prior Art

According to the conventional vehicle door lock mechanism, when the lock lever is operated to its locked position as well known a connection route between open handles and a latch mechanism of the lock device is cut off. Consequently, operating one of the opening handles installed on the outside and the inside of the vehicle door cannot open the door. However, a crime prevention function of the lock lever above is not complete. For example, if a metal tool is inserted into the door lock device through a gap between the door and the vehicle body in order to rotate the lock lever to its unlock position, it is possible to open the door without a key. It may be an injustice action.

UK2,227,049A discloses a super lock or a lock device with a dead lock mechanism adapted to prevent a lock lever of the lock device from being forceably opened by a metal tool. According to the concrete structure of the super lock, a super lock member which is adapted to be displaced by motor is adapted to be engaged with the lock lever and so that the lock lever doesn't displace except for the engagement of the super lock member with the lock lever is not disengaged.

According to the well-known super lock mechanism above, once the lock device is under its super locked condition, it becomes impossible to open the door by any means of manual operation or means on the outside or the inside of the vehicle. Consequently, if a driver not accustomed to the super lock mechanism operates the mechanism incorrectly, the driver faces a very serious situation. It is possible for a driver to be trapped in the car when he or she incorrectly operates the super lock mechanism or breaks the mechanism. In light of the increased usage of the super lock mechanism, it is necessary to take countermeasures for incorrect use of the super lock mechanism by unaccustomed drivers.

SUMMARY OF THE INVENTION

Purpose of the Invention

Consequently, it is the purpose of the present invention to provide a vehicle door lock device with a super lock mechanism to enable effective use by any driver of the car who is unfamiliar with the mechanism.

According to the present invention, in order to attain its purpose, the super lock mechanism of the vehicle door lock device has a switch turned on when a key is inserted in an ignition key cylinder in the driver's seat, another switch turned on when a person is in the interior of the car, still another switch turned on when the door is opened, still another switch adapted to be turned on while the trunk is opened, and still another switch adapted to be turned on when a window is opened, wherein if anyone of the switches is turned on when it is changed to a super locked condition, an alarm buzzer sounds or the super lock condition is stopped.

According to another purpose of the present invention, a vehicle door lock device with a super lock mechanism permits release of its super locked condition by an operation from the interior of the car in case of emergency while a car is in motion. According to the present invention, the vehicle door lock device has a switch adapted to be turned on when a key is inserted into the ignition key cylinder at the driver's seat and another switch adapted to be turned on when there is a person in the car, wherein when one of these switches is turned on, it is presumed that the car is being driven and the central lock switch in the car is unlocked to release the super lock.

PREFERRED EMBODIMENTS OF THE INVENTION

Preferred embodiments of the vehicle door lock device having a super lock mechanism according to the present invention will be described with reference to the accompanying drawings.

Figure 2:
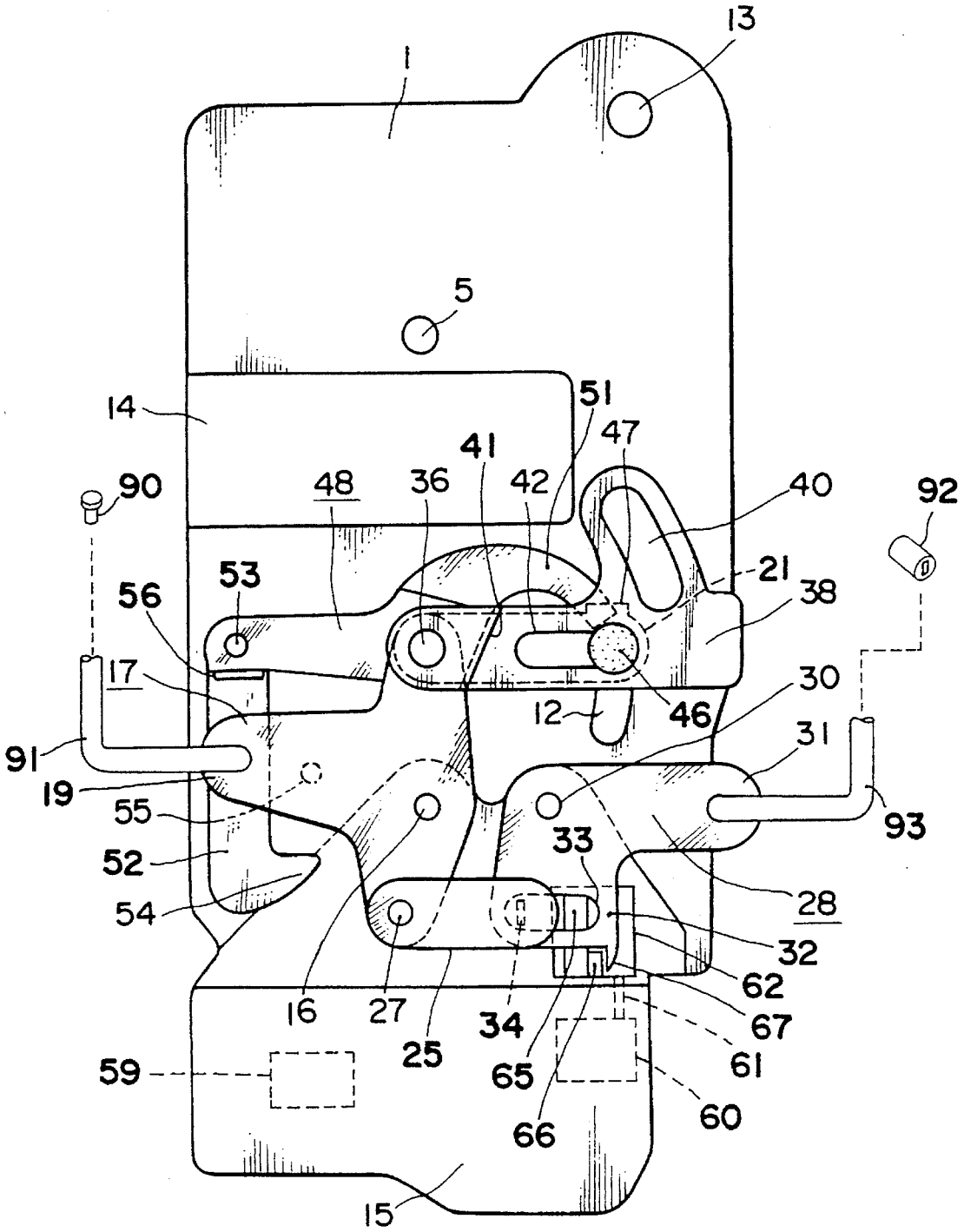
FIG. 2 is a rear view of the lock device under its unlocked condition after the back plate is removed.

The synthetic resin-made body 1 of the door lock device according to the present invention has a concave portion 2 formed on its front side. In the concave portion 2, there is a latch 4 adapted to engage with a striker 3 and rotate, and a ratchet 6 adapted to engage with the latch 4 and prevent the latch 4 from reverse-rotating. The latch 4 is journalled by a shaft 5 and the ratchet 6 is journalled by a shaft 7. As shown in FIG. 2 the body 1 has a convex portion 14 which has a cross-section substantially of a letter C. The interior of the convex portion 14 is a passage 9 through which the striker 3 passes. There is a wedge 10 holding the striker 3 in the passage 9.

Figure 6:
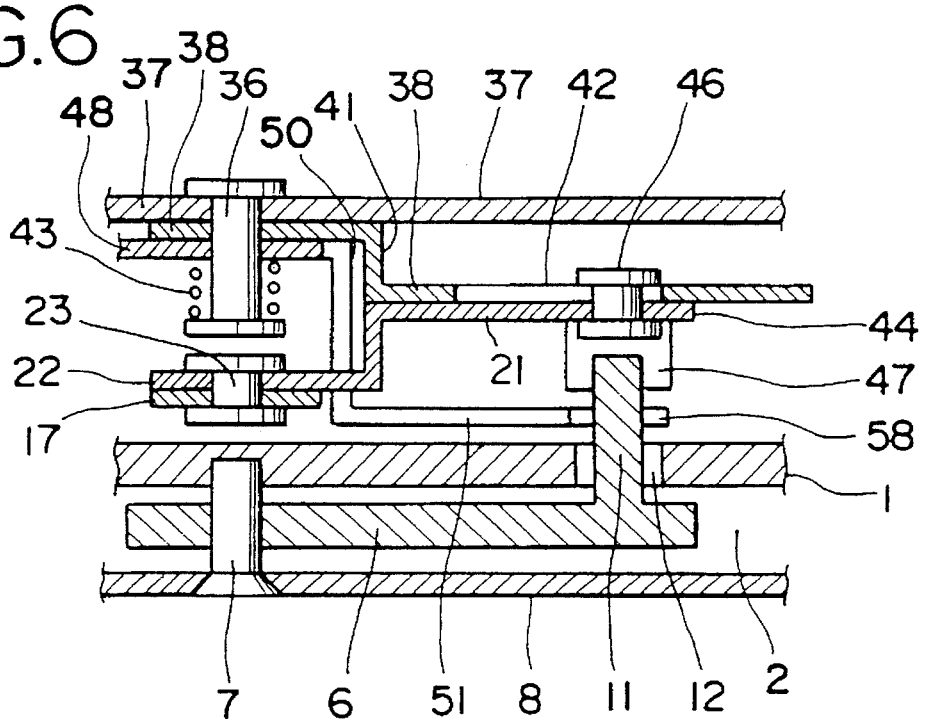
FIG. 6 is a section of a primary portion of the lock device.

The ratchet 6 has an engagement pin 11 protruding to the rear of the body 1, which is integrally formed with the ratchet 6 (see FIG. 6). The engagement pin 11 protrudes through an arc opening 12 formed in the body 1. The concave portion 2 is closed by a metal-made cover plate 8. The lock device of the present invention is secured to the vehicle door by a screw (not shown) passing through a screw hole 13 formed in the body 1.

Figure 5:
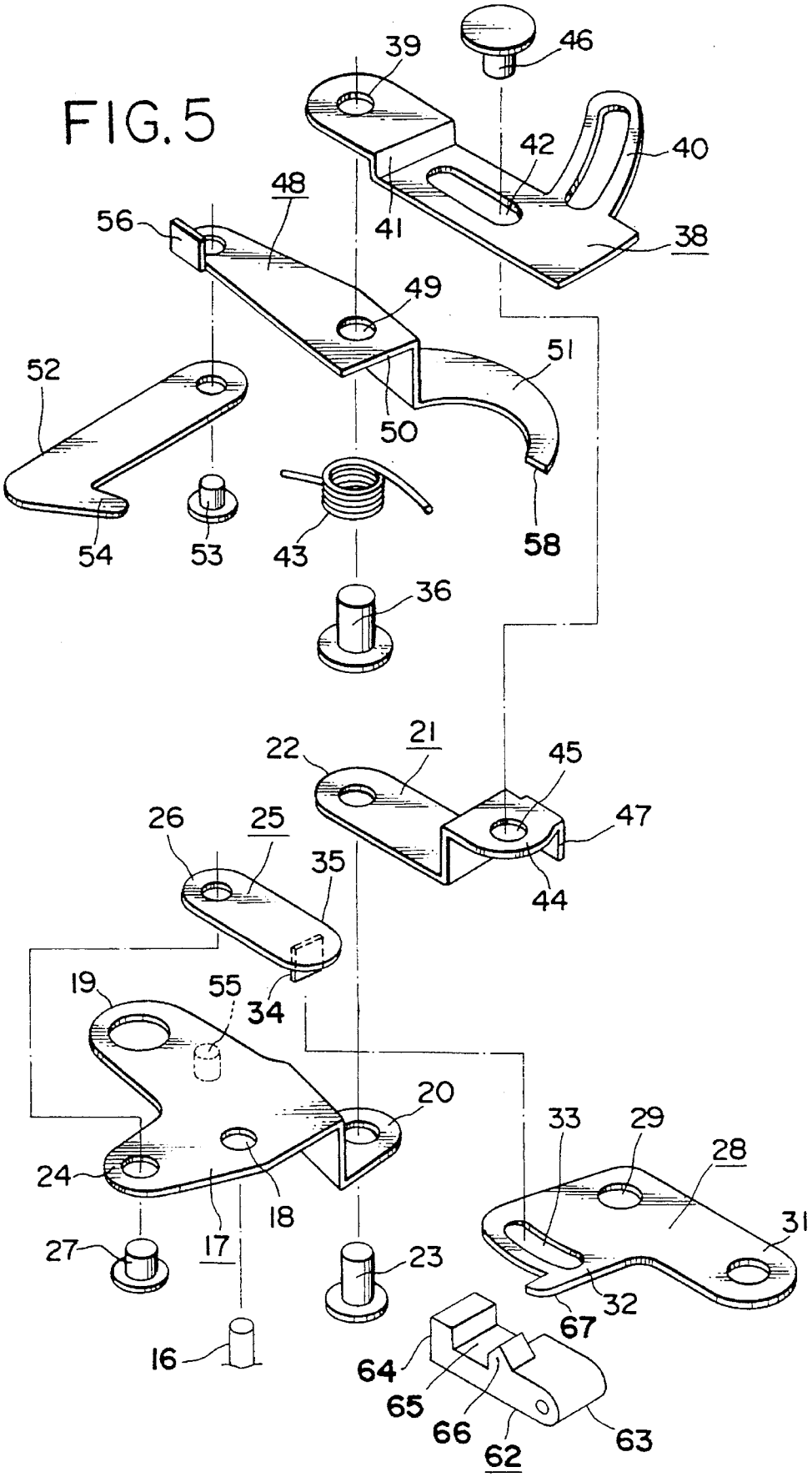
FIG. 5 is an exploded perspective of a group of levers.

As shown in FIG. 2, an actuator portion 15 is attached to a lower portion of the body 1. The actuator portion 15 has a conventional-lock-motor 59 and a super-lock-motor 60. Power from the motor 59 is delivered by output shaft 16. As shown in FIGS. 2 and 5, the output shaft 16 extends through and is secured in a journal hole 18 of the inside lock lever 17. The lock lever 17 is adapted to rotate, when the output shaft 16 rotates. The lock lever 17 changes the condition of the lock device between being locked and unlocked in a conventional manner, so that detailed explanation of the lock lever 17 is omitted from the following description. An unlocked position of the lock lever 17 is shown in FIG. 2 and its locked position is in FIG. 3. The exchanging operation of the lock lever 17 will be explained in detail.

The inside lock lever 17 has three leg portions. A rod 91 extending to an inside lock member 90 of the vehicle door is connected to the first leg portion 19 of the inside lock lever 17, a left end 22 of a link 21 is connected to the second leg portions 20 by a shaft 23 (see FIG. 3 and FIG. 5), and an end 26 of the connection link 25 is connected or journalled to the third leg portion 24 through a shaft 27. In addition, an axis of the shaft 23 overlaps the axes of the shaft 36 and shaft 7 of the ratchet 6 when the lock lever 17 resides in its unlocked condition as shown in FIG. 2.

There is a key lock lever 28 of substantially L-shaped is placed by the inside lock lever 17. A shaft 30 passes through and is secured in a shaft hole 29 of the key lock lever 28. A rod 93 extending to a key cylinder 92 of the door is securely connected to a first arm 31 of the key lock lever 28 without a lost motion. When the key lock lever 28 and the key cylinder 92 are firmly connected or both the lever 28 and cylinder 92 are integrally constructed, the lock lever 28 is not rotated notwithstanding rotation of the key cylinder 92. Only rotation of the key for the door can rotate the key lock lever 28.

A second arm 32 of the key lock lever 28 has an arc opening 33 with a radius of the distance to the shaft 30. Through the arc opening 33, a protrusion 34 protruded from the other end 35 of the connection link 25 to the front side of the body 1 passes in order to connect the key lock lever 28 to the inside lock lever 17 through the connection link 25. Additionally, a lost motion constructed by the arc or ellipse opening 33 and the protrusion 34 is formed between the key lock lever 28 and the inside lock lever 17. Due to function of the lost motion, it is possible that the inside lock lever 17 can independently rotate without rotating a key lock lever 28. Accordingly, when the inside lock lever 17 is rotated counterclockwise through the inside lock member 90 in FIG. 2, only the inside lock lever 17 moves to its locked position without moving the key lock lever 28. When the key cylinder 92 rotates the key lock lever 28 in FIG. 2 counterclockwise, the ellipse opening 33 engages with the protrusion 34 and the connection link 25 moves to the right resulting in a counterclockwise rotation of the inside lock lever 17 and placing the inside lock lever 17 in its locked position.

Figure 3:
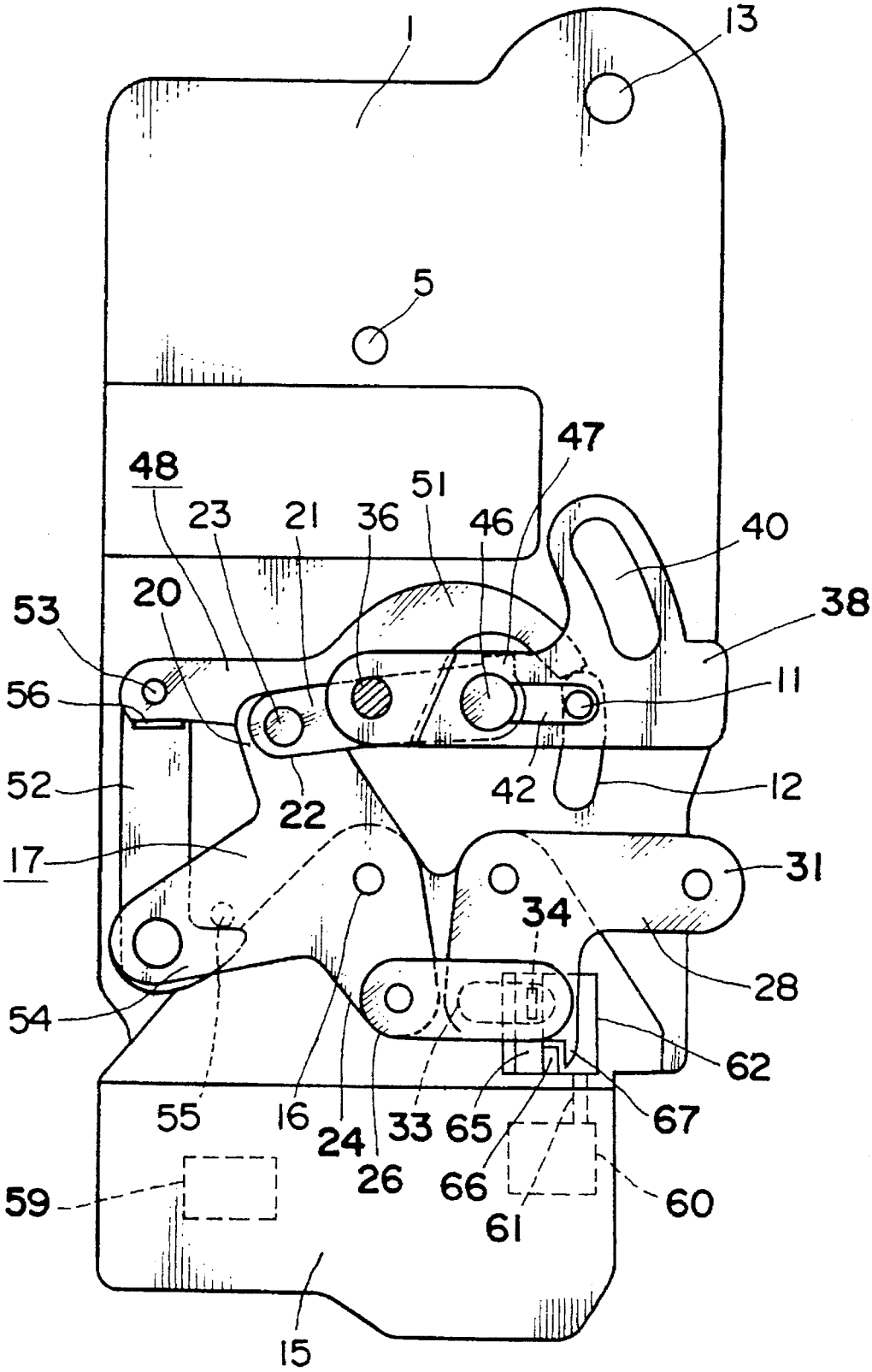
FIG. 3 is a rear view of the lock device under its locked condition after the back plate is removed.
Figure 4:
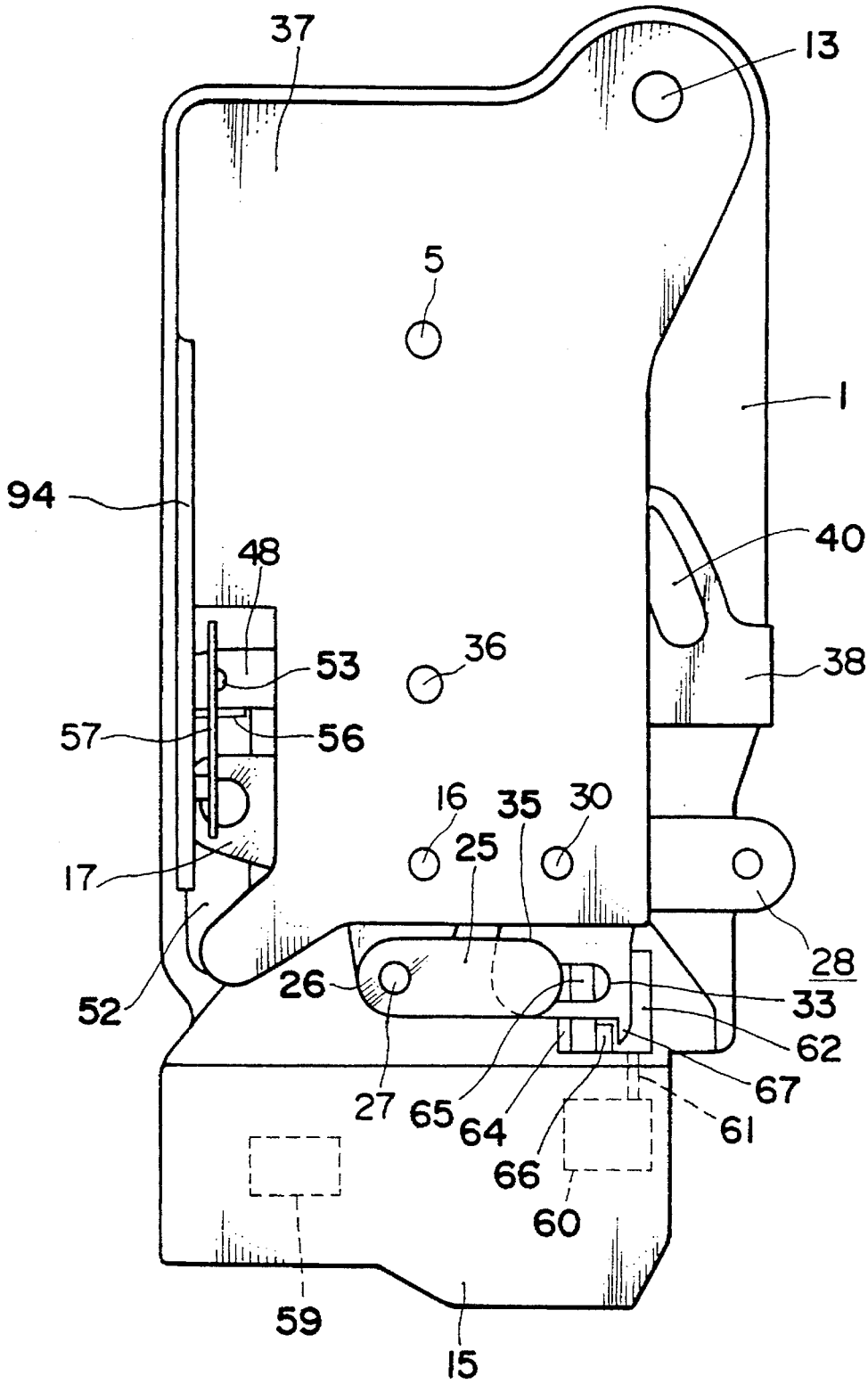
FIG. 4 is a rear view of the lock device.

As shown in FIG. 4 and FIG. 6, a metal-made back plate 37 is attached to the rear side of the body 1. A shaft 36 positioned on the same axis of the shaft 7 of the ratchet 6 is secured to the back plate 37. A shaft hole 39 of the first open lever 38 rotatably surrounds the shaft 36. The first open lever 38 has an oval opening or hole 40 with a radius of a distance from the shaft 36 formed at its front end portion. A rod (not shown) extending to a outer handle of the door is connected to the oval opening 40. The first open lever 38 has an oval hole 42 extending along a radial direction of the shaft hole 39 formed therein and a stepped portion 41 (FIG. 5) is formed between the oval opening 42 and the shaft hole 39. The first open lever 38 is urged along a counterclockwise direction in FIG. 2 and FIG. 3 by means of a spring 43 shown in FIG. 5.

The link 21 has a shaft hole 45 formed at its right end 44. A connection pin 46 passes through the shaft hole 45 and the oval hole 42 of the first open lever 38. When operation of the outer handle rotates the first open lever 38 clockwise in FIG. 2, the link 21 too rotates clockwise around the shaft 23 by the connection pin 46. When the inside lock lever 17 is displaced, the link 21 is also displaced in the left and right direction with a guide engagement of the oval hole 42 and the connection pin 46.

The link 21 has an abutting piece 47 bent at a right angle toward the front side, which abutting piece 47 being formed at its right end 44 of link 21. The abutting piece 47 faces to the engagement pin 11 of the ratchet 6 when the inside lock lever 17 is placed at its unlock position. When the first open lever 38 rotates clockwise the link 21, the abutting piece 47 presses the engagement pin 11 disengaging the ratchet 6 from the latch 4 and permitting the door to be opened. However, when the inside lock lever 17 is at its locked position, the abutting piece 47 is separated from the engagement pin 11 disenabling the ratchet 6 to move even though the first open lever 38 rotates.

A second open lever 48 has a shape lengthened in a right-and-left direction and a shaft hole 49 formed at its right-and-left direction center is rotatably journalled to the shaft 36. As shown in FIG. 4, the second open lever 48 has an engagement piece 56 formed at its left portion and an inner lever 57 journalled to a bent portion 94 of the lock plate 37 is engaged with the engagement piece 56. An inner handle (not shown) of the door is connected to the inner lever 57.

As shown in FIG. 5, the second open lever 48 has formed thereon an abutting face 50 adapted to abut with the stepped portion 41 of the first open lever 38. When the second open lever 48 rotates clockwise by the inner lever 57, the abutting face 50 abuts with the stepped portion 41 of the first open lever 38 rotating the first open lever 38 clockwise around the shaft 36.

The second open lever 48 has an arc arm 51 provided with a front end 58 facing the engagement pin 11. As shown in FIG. 6, the front end 58 is placed below the abutting piece 47. When the second open lever 48 rotates, it abuts directly on the engagement pin 11. As a result, when the inner handle on the vehicle door rotates the second open lever 48, the door opens while even it is at a locked condition.

A lever 52 is fixed to a left end of the second open lever 48 through a pin 53. A lower end of the lever 52 has a claw portion 54 formed thereon. The claw portion 54 is adapted to engage with a protrusion 55 of the inside lock lever 17. When the inside lock lever 17 is placed at its locked position shown in FIG. 3 and the second lock lever 48 is rotated clockwise, the claw portion 54 engages with the protrusion 55 in order to rotate the inside lock lever 17 to its unlocked position.

The arc arm 51 and lever 52 constitute so-called one-motion mechanism enabling the opening of the door by only operation of the door inner handle even if the door lock device is locked. It is preferable to install the one-motion mechanism only at a lock device for the door at the driver's seat (hereafter, referred to as a main lock device), and the mechanism is not used for a lock device at the navigator's seat (hereinafter, referred to as a subsidiary lock device).

Figure 7:
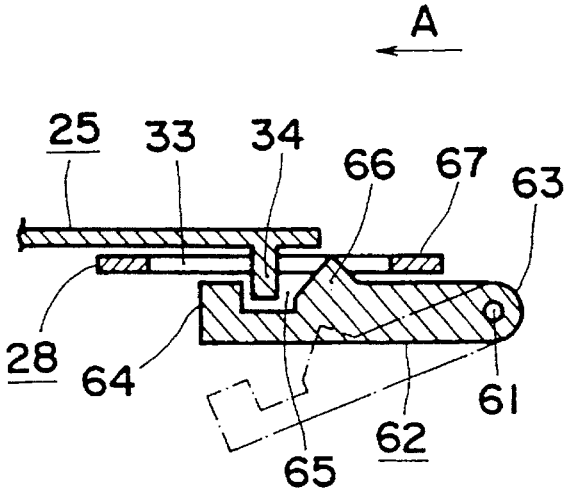
FIG. 7 is a section of the super lock during operation.

As shown in FIG. 5, base portion 63 of the super lock member 62 is secured to an output shaft 61 of the super-lock-motor 60 or motor for the super lock. A front end side 64 of the super lock member 62 has a concave 65 formed thereon. Rotation of the motor 60 changes position of member 62 between a super locked position shown by solid lines and a released position shown by imaginary lines in FIG. 7. When the inside lock lever 17 is placed at its locked position and the super lock member 62 moves to its super locked position, a protrusion 34 of the connection link 25 engages with the concave 65, so that the inside lock lever 17 becomes impossible to rotate in an unlock direction. Basically, the motor 60 is adapted to rotate in a locking direction when the lock device is changed to its locked condition by an operation from the outside.

The super lock member 62 has a cam portion 66 formed at substantially its mid position along a left-and-right direction. A releasing protrusion 67 adapted to abut on the cam portion 66 is formed at a front end of the second arm 32 of the key lock lever 28. When the key lock lever 28 rotates to a side of unlocking by a key manual operation (along an arrow direction in FIG. 7), the releasing protrusion 67 abuts on the cam portion 66 to rotate the super lock member 62 around the output shaft 61 returning it to a released position. In addition, the releasing means for the super locked condition by the releasing protrusion 67 is a countermeasure for safety if the super-lock-motor 60 is broken.

Figure 8:
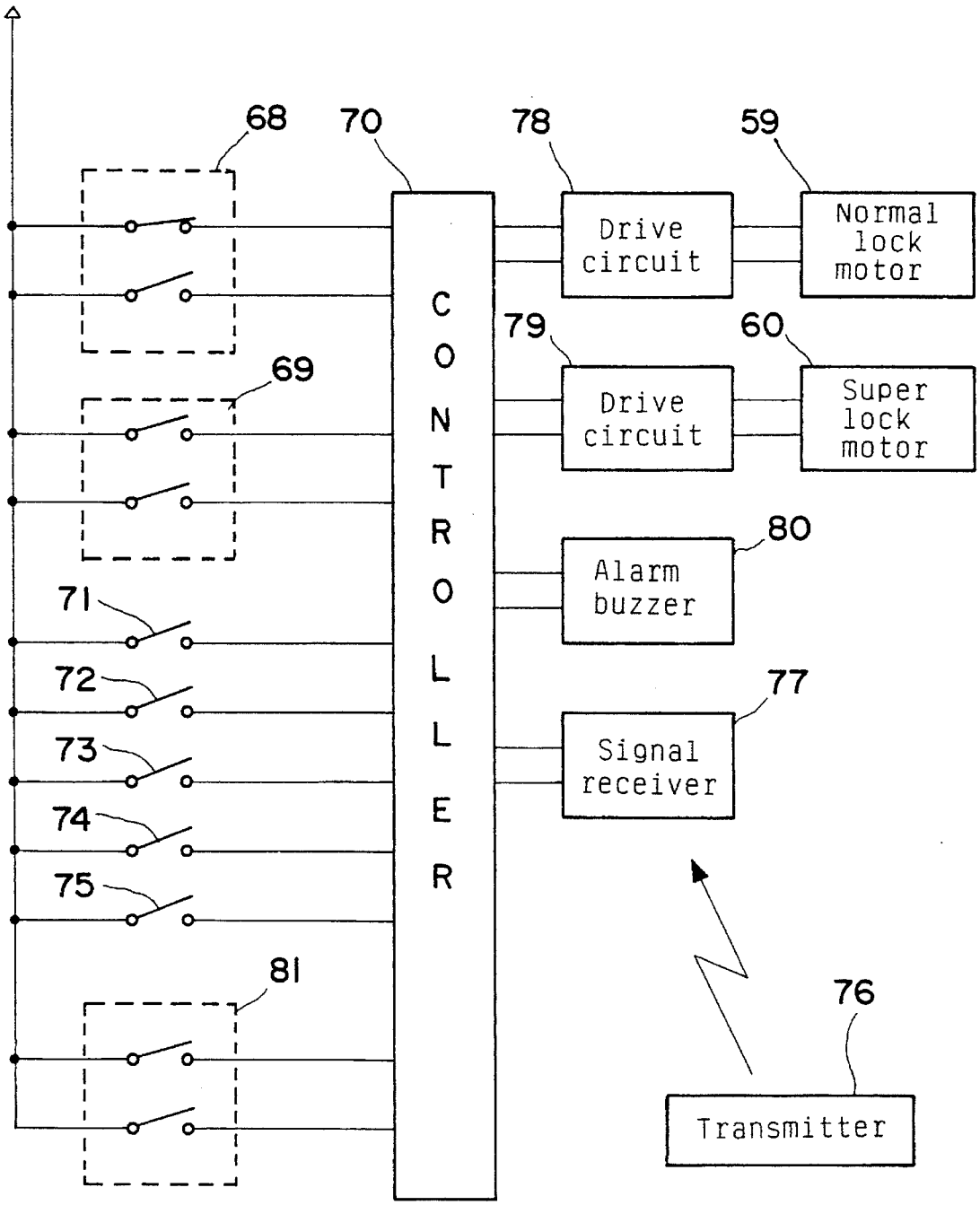
FIG. 8 is a block diagram for controlling the lock device.

FIG. 8 is a block diagram for controlling the lock device. A switch 68 installed on the actuator 15 watches a position of the inside lock lever 17 or output shaft 16 in order to detect a locked condition or unlocked condition of the lock device. Another switch 69 installed on the actuator 15 watches motion of the key lock lever 28 or shaft 30 in order to detect a locking operation or unlocking operation of the key.

Switches 71 to 75 detect various conditions of the car and the detection results are outputted on the controller 70. The controller 70 is ordinarily fixed alone to the desired position of the car. The switch 71 is turned on when a key is in the ignition key cylinder at the driver's seat. The switch 72 is turned on when the driver is seated. The switch 73 is turned on when the door is open (in the drawing, only one switch is shown, but in practice all doors have one switch, respectively). The switch 74 is turned on when the trunk is open. The switch 75 is turned on when the window is open (only one switch is shown in the drawing, but practically all windows have one switch, respectively).

The switches 71 to 75 are adapted to set the operative condition of the super lock of the motor 60. According to the lock device of the first embodiment of the present invention shown in FIGS. 9 to 11, when the super lock is functioned and even one of the switches 71 to 75 is of a condition ON, the alarm buzzer 80 sounds altering the driver to the situation. According to the second embodiment shown in FIGS. 12 to 15, when even one of the switches 71 to 75 is of condition ON, the lock device fails to turn to a super locked condition.

Signals from the portable transmitter 76 controlling the lock device is received by a signal receiving portion 77. The transmitter 76 for outputting coded signals of a kind according to infrared rays or electric waves has a well known structure, so that detailed explanation of the structure will be omitted from the following description. The lock device controlling circuit shown in FIG. 8 has a drive circuit 78 for the normal-lock-motor 59, a drive circuit 79 for the super-lock-motor 60, and a central lock switch 81 installed in the car in order to operate the normal-lock-motor 59. When the lock switch 81 is operated to lock the lock device, the motor 59 for the lock device rotates in a locking direction. When the lock switch 81 is operated to unlock the device, the motor 59 rotates in a unlocking direction. According to the present invention, the lock switch 81 provided with a conventional structure is adapted to flow current to the super-lock-motor 60 so as to release the lock device when the switch 71 or 72 is turned on and the lock switch 81 is operated to unlock the lock device.

Figure 9:
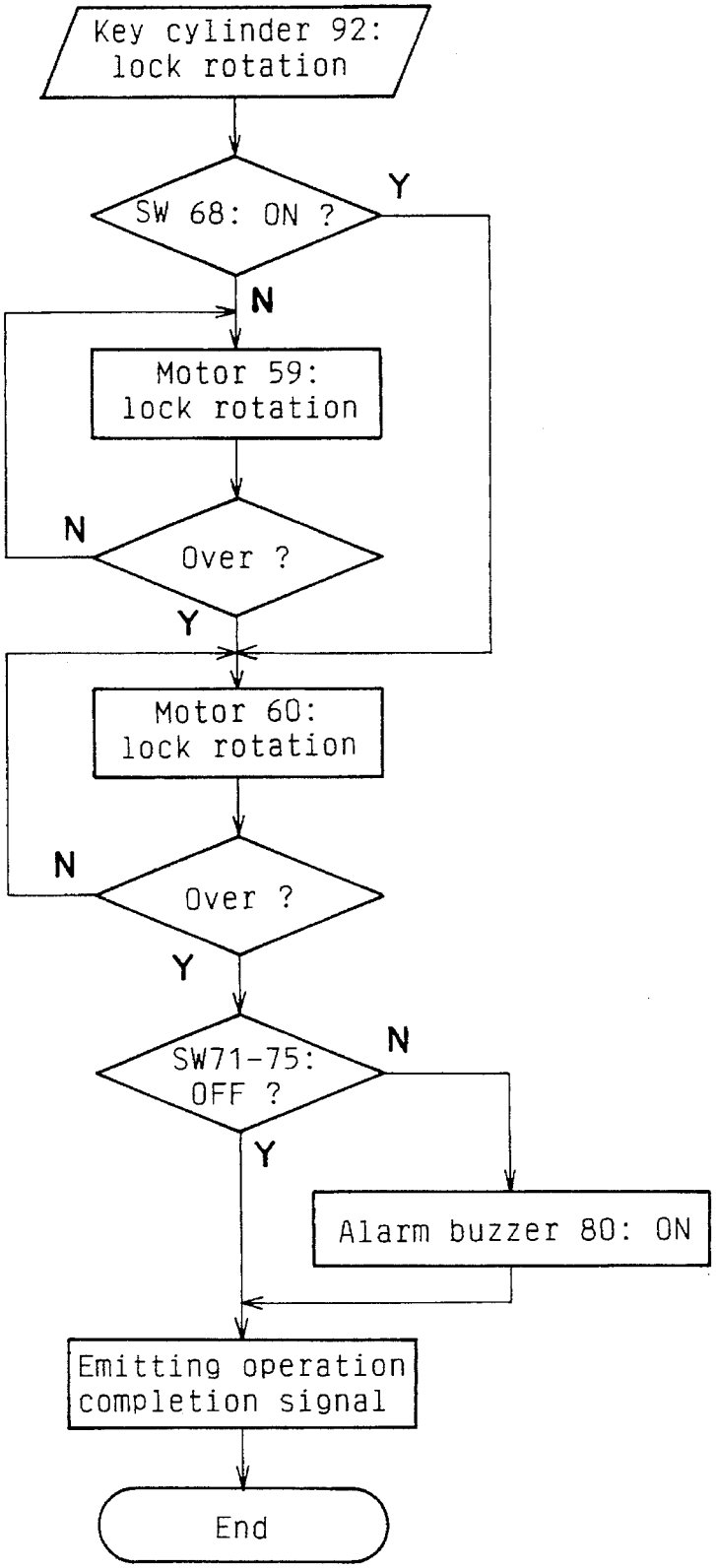
FIG. 9 is a flow chart of the first embodiment of the lock device when the key cylinder rotates to lock the device.
Figure 10:
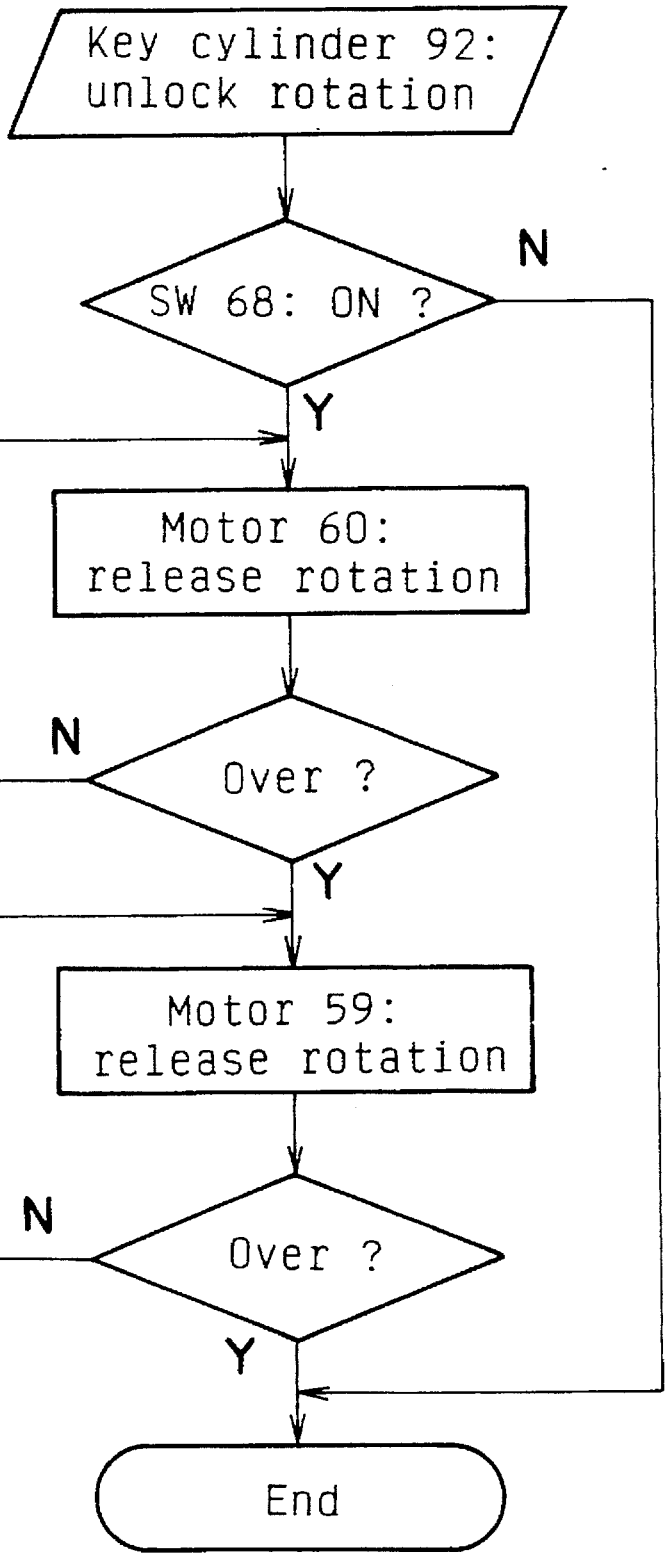
FIG. 10 is a flow chart of the first embodiment when the key cylinder rotates to unlock the device.
Figure 11:
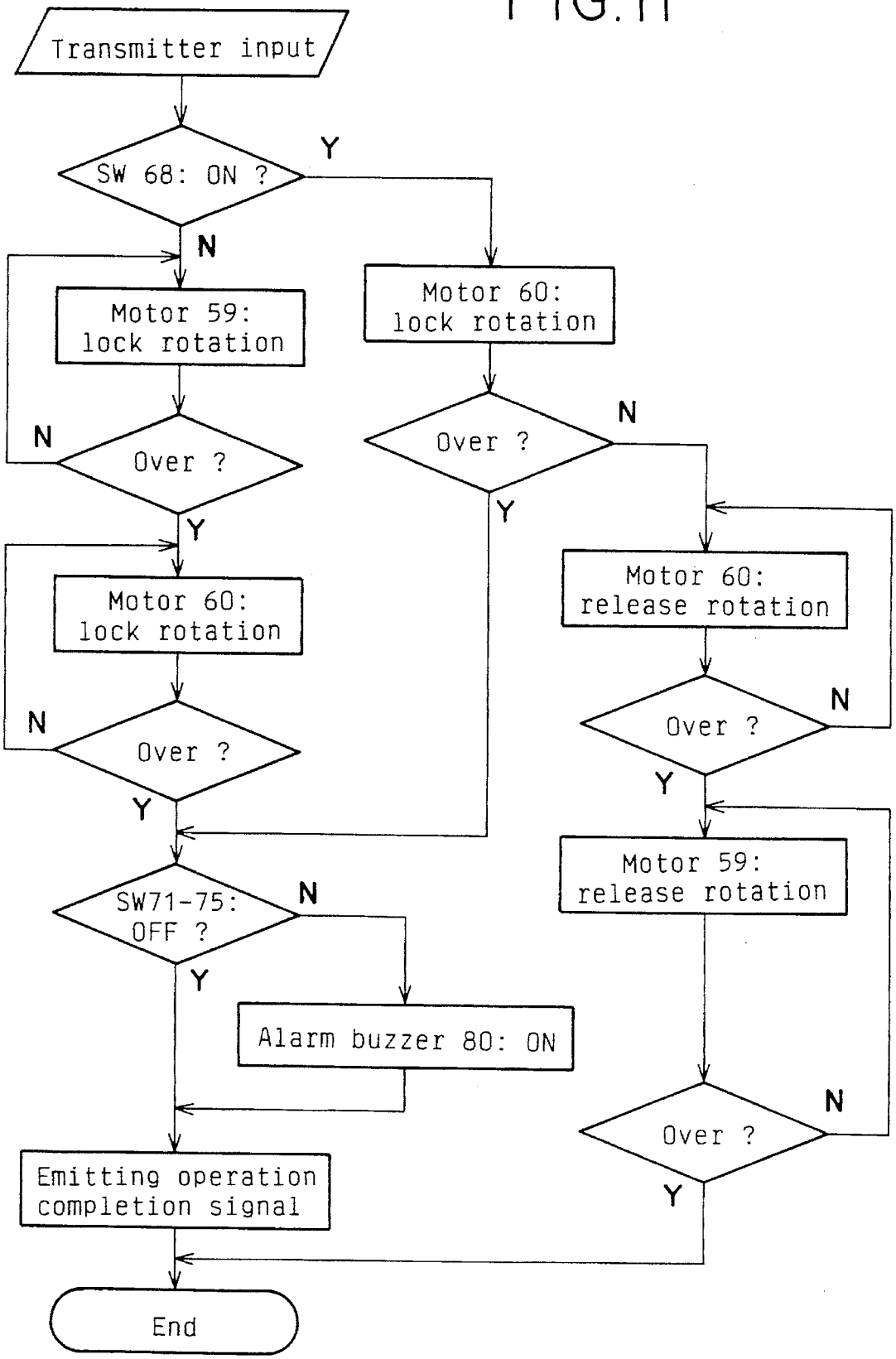
FIG. 11 is a flow chart of the first embodiment of the lock device when it receives an operative signal of the transmitter.

Operation of First embodiment shown in FIGS. 9 to 11

First, operation of the lock device of the first embodiment shown in FIGS. 9 to 11 will be described.

Figure 1:
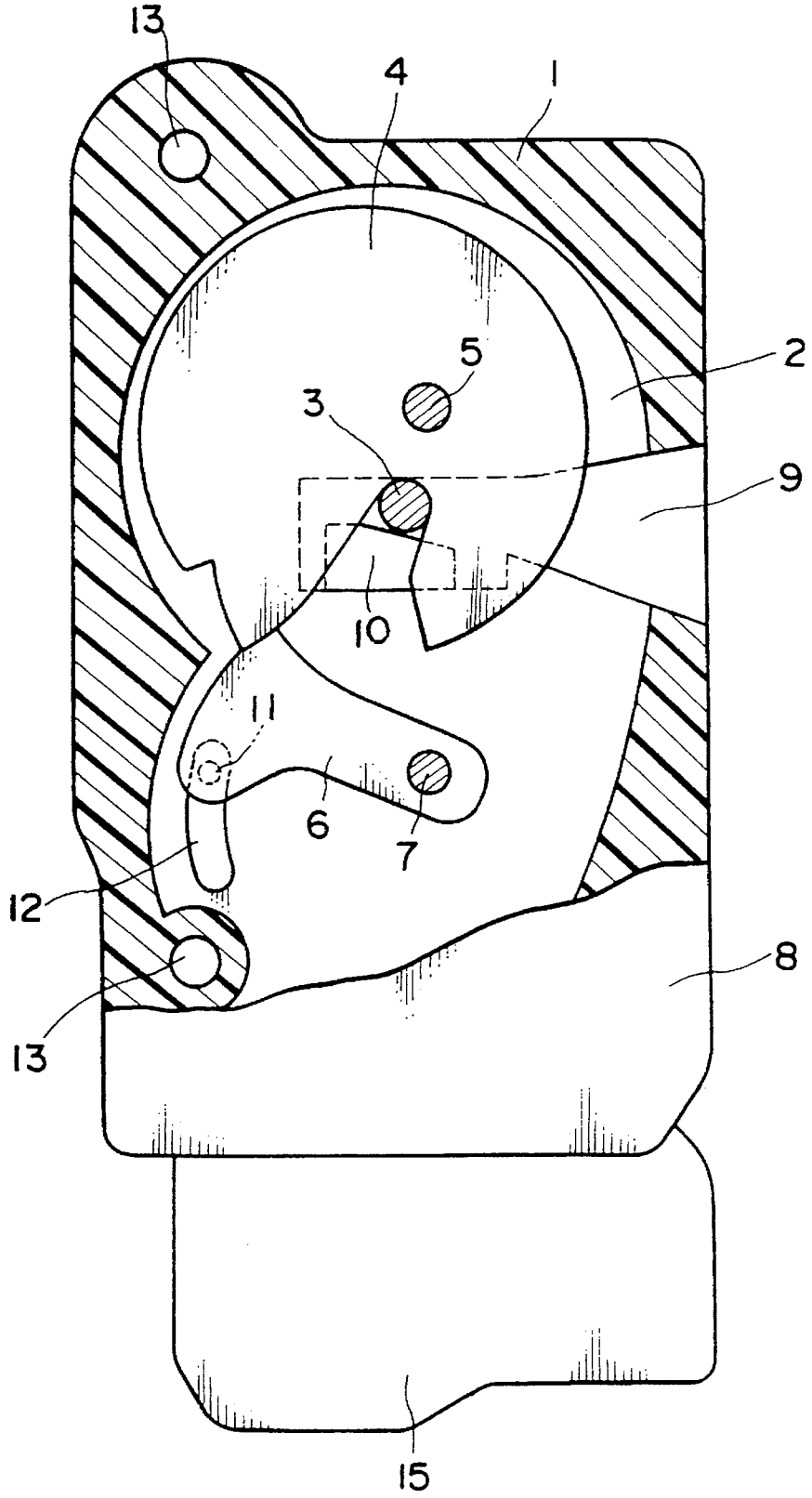
FIG. 1 is a partly-longitudinal-section front view of the lock device.

When the door is closed, the striker 3 enters into the passage 9 and engages with the latch 4, the latch 4 engages with the ratchet 6 closing the door (FIGS. 1 and 2).

After that, an outer handle (not shown) is operated to open the door in order to rotate clockwise the first open lever 38, thereby the link 21 rotates clockwise around the shaft 23 by the connection pin 46. Consequently, an abutting piece 47 of the link 21 pushes the engagement pin 11 in order to counterclockwise rotate the ratchet: 6 as shown in FIG. 1 and to release or disengage the ratchet 6 from the latch 4 enabling opening of the door.

When a key is inserted into the key cylinder 92 at the door of the driver's seat and turned in the locking direction while various parts of the mechanism are positioned as shown in FIG. 2, the key lock lever 28 counterclockwise rotates through the rod 93, and the inside lock lever 17 rotates counterclockwise through the connection link 25. As a result, the link 21 connected to the inside lock lever 17 by the shaft 23 moves to the left and the abutting piece 47 disengages from the engagement pin 11 resulting in a locked condition of the lock device (FIG. 3).

Simultaneously, the lock operation detection switch 69 detects a locking directional rotation of the shaft 30 of the key lock lever 28. When a subsidiary lock device is at its unlocked condition as shown in FIG. 9, the normal-lock-motor 59 of the subsidiary lock device is impressed changing the subsidiary lock device to its locked condition. After the exchange of the subsidiary lock device is completed, the super-lock-motor 60 of the all lock device is impressed in order to rotate the output shaft 61 displacing the super lock member 62 to its super locked position. Then, if only one of the switches 71 to 75 has been turned on, the alarm buzzer 80 sounds to make the driver known of the situation.

Then, at the situation of locked condition, even when the outer handle is operated to clockwise rotate the first open lever 38, the abutting piece 47 doesn't engage with the engagement pin 11, so the ratchet 6 is kept at its engaged condition with the latch 4 failing to open the door. When a super locked condition is attained, the concave 65 of the super lock member 62 engages with the protrusion 34 of the connection link 25, so it is impossible to insert a thin metal tool through a gap of the door to move the inside lock lever 17 attaining high-crime-preventability.

Additionally, when the lock member 90 installed at the inside of the door is operated as shown in FIG. 2 in order to change the inside lock lever 17 to its locked position, only the inside lock lever 17 rotates, a lost motion of the oval hole 33 and the protrusion 34 prevents the key lock lever 28 from rotating and the motor 60 from operating.

On the contrary, when a super locked condition or locked condition is attained and a key is inserted into the key cylinder 92 of the door turning it in its unlocking direction, the key lock lever 28 and shaft 30 rotate clockwise from their positions shown in FIG. 3 and the lock operation detection switch 69 detects an unlocking operation by means of rotary displacement of the shaft 30. As shown in FIG. 10, owing to the detection, the super-lock-motor 60 of the lock device is impressed and the super lock member 62 is displaced to its released position shown by imaginary lines of FIG. 7. Continuously, the normal-lock-motor 59 is impressed by electric current, the output shaft 16 rotates clockwise the inside lock lever 17 bringing the inside lock lever 17 to its unlocked position shown in FIG. 2.

In addition, if the super-lock-motor 60 happens to fail to operate due to some troubles, the key is rotated in its unlocking direction so as to make the releasing protrusion 67 of the key lock lever 28 abut on the cam portion 66 of the super lock member 62. Consequently, it is possible to physically displace the super lock member 62 to its released position shown by imaginary lines shown in FIG. 7.

Next, various operations using the portable transmitter 76 will be explained.

It is one kind of the output signal (operation signals) to be emitted from the transmitter 76, so that when the receiving portion 77 receives an output signal from the transmitter 76, the lock condition detection switch 68 confirms that the lock device is at its locked condition or unlocked one.

When it is at a unlocked condition, output signals from the transmitter 76 is handled as lock operative signals impressing the normal-lock-motor 59 of the all lock device and displacing the inside lock lever 17 to its locked position. Continuously, the super-lock-motor 60 is impressed in order to rotate the output shaft 61 and displace the super lock member 62 at its super locked position. Then, when even one of the switches 71 to 75 has been turned on, the alarm buzzer 80 sounds making the driver known of the situation.

On the contrary, when it is at a locked condition, current used to rotate in a locking direction is impressed to the super-lock-motor 60. Consequently, when the motor 60 fails to rotate, it is known that the lock device is already at its super locked condition. An output signal from the transmitter 76 is handled as a lock releasing signal supplying a current for release-rotation of the super-lock-motor 60, so that the super lock member 62 is displaced to a released position. Then, the normal-lock-motor 59 is impressed in order to displace the inside lock lever 17 to its unlock position.

When a lock rotation current rotates the super-lock-motor 60, output signals emitted from the transmitter 76 are handled as super lock operative signals, the super-lock-motor 60 is impressed to displace the super lock member 62 to a super lock position. Simultaneously, the switches 71 to 75 confirm super lock conditions. If these super lock conditions aren't satisfied, the driver is warned.

Operation of Second embodiment shown in FIGS. 12 to 15

Next, operation of the lock device of the second embodiment will be explained with reference to FIGS. 12 to 15.

At the condition of the lock device shown in FIG. 2, when a key is inserted into the key cylinder 92 on the door by the driver's seat and the key rotates in its locking direction, the key lock lever 28 counterclockwise rotates through a rod 93 and also the inside lock lever 17 counterclockwise rotates through the connection link 25. As a result, the link 21 connected to the inside lock lever 17 by a shaft 23 moves to the left, and the abutting piece 47 disengages from the engagement pin 11 resulting in a locked condition of the lock device (FIG. 3).

Figure 12:
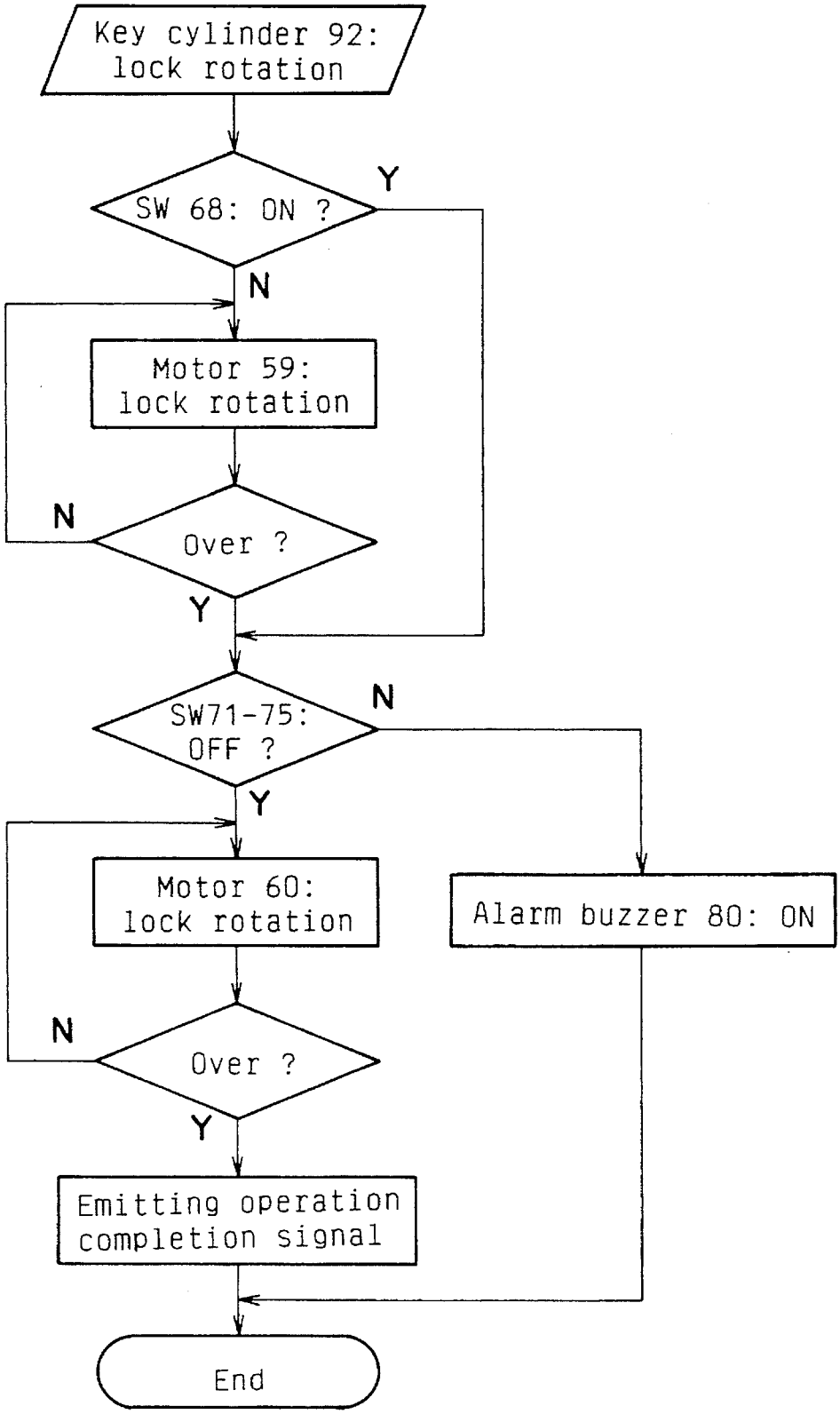
FIG. 12 is a flow chart of the second embodiment of the lock device when the key cylinder is turned to lock the device.

Simultaneously, the lock operation detection switch 69 detects that the shaft 30 of the key lock lever 28 has rotated in a locking direction. When the detection switch 69 detects that the subsidiary lock device is at its unlocked condition as shown in FIG. 12, the normal-lock-motor 59 of the subsidiary lock device is impressed and a condition of the subsidiary lock device is changed to its locked position. After the change, the switches 71 to 75 confirm operative conditions of the super lock. When all switches have turned off, the super-lock-motor 60 of the all lock device is impressed in order to rotate the output shaft 61 in order to displace the super lock member 62 to its super lock position. If even one of these switches 71 to 75 is at its on condition, the alarm buzzer 80 sounds to make the driver known of the situation, and the super-lock-motor 60 is not impressed.

Figure 13:
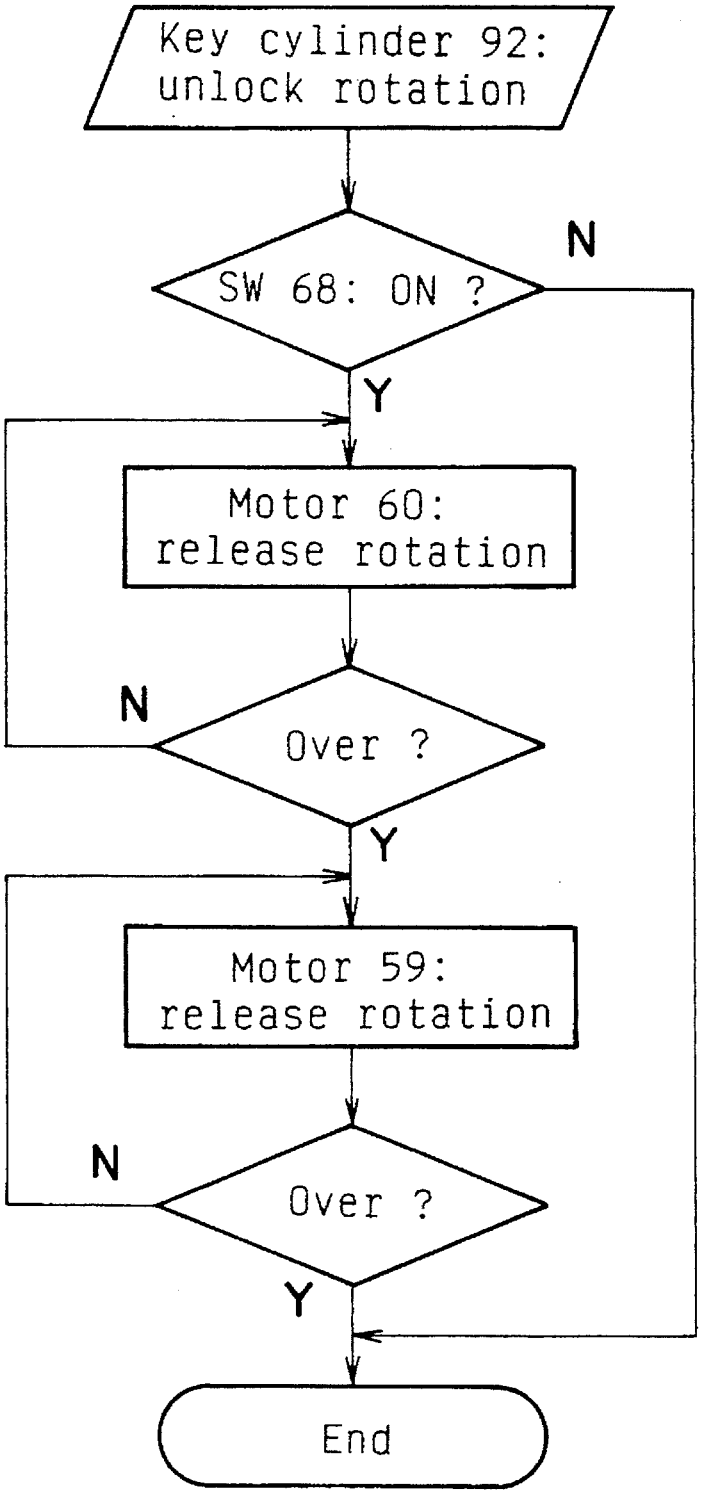
FIG. 13 is a flow chart of the second embodiment of the lock device when the key cylinder is turned to unlock the device.
Figure 14:
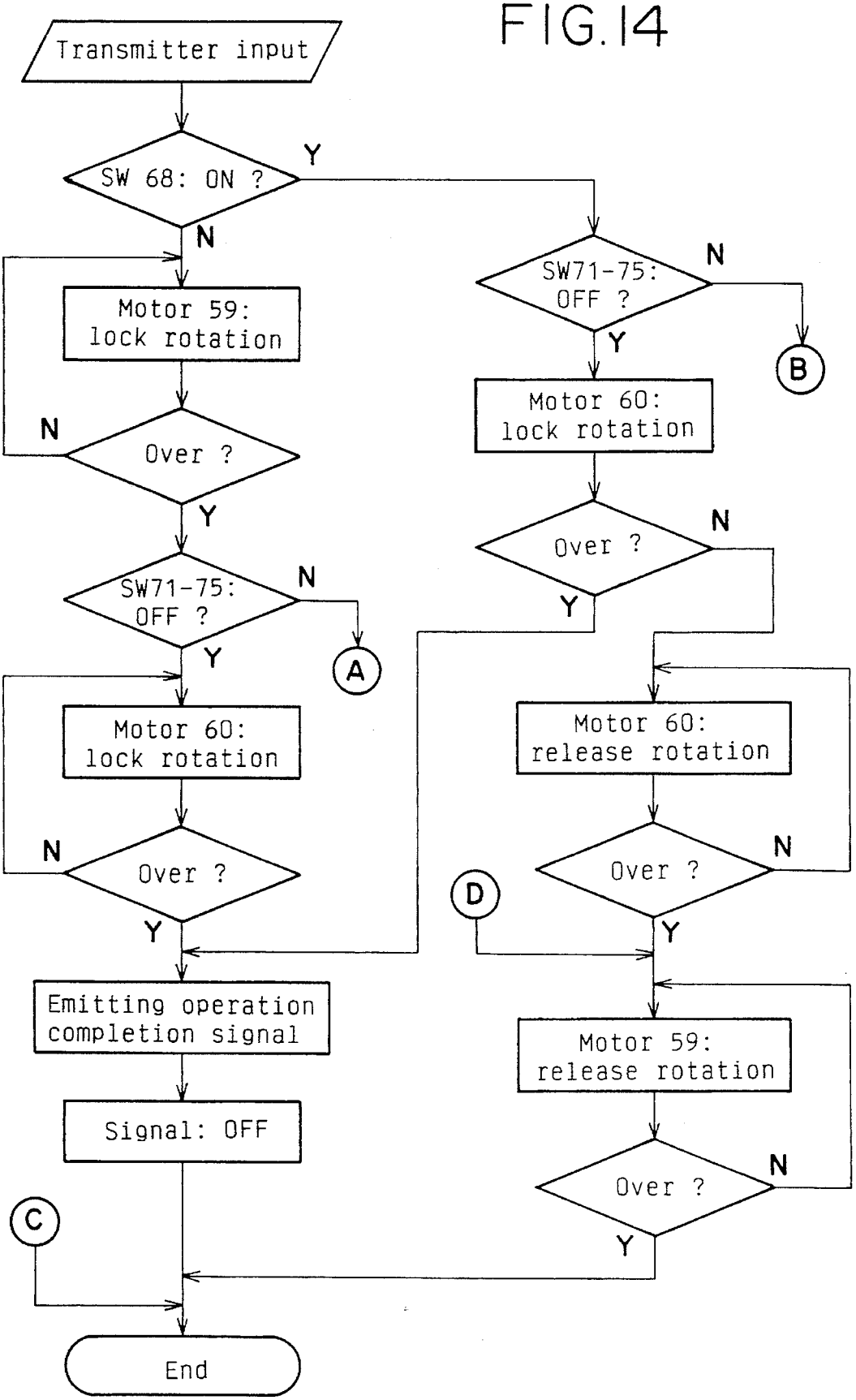
FIG. 14 and FIG. 15 are flow charts of the second embodiment when the lock device receives operative signals of the transmitter.
Figure 15:
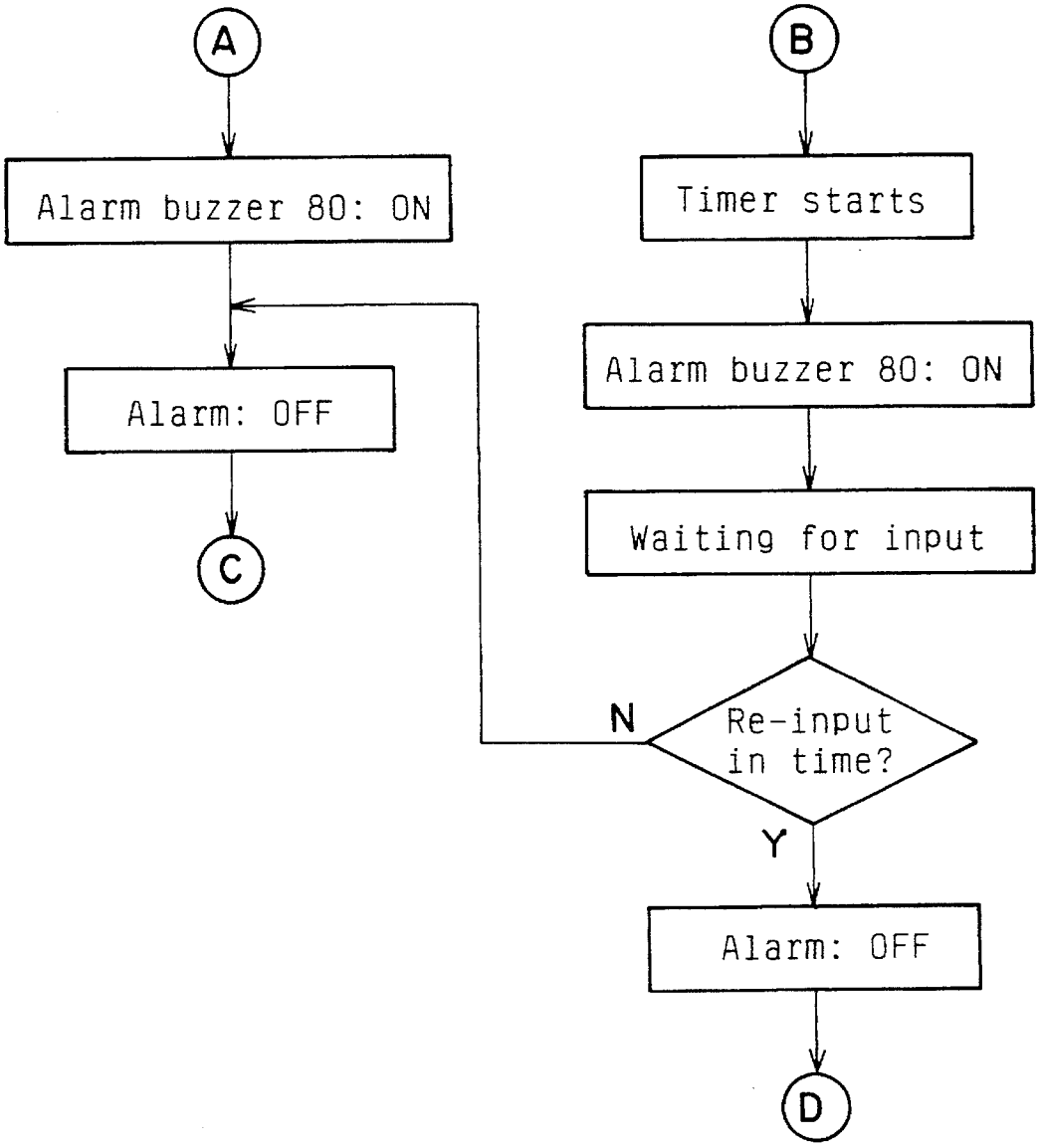

When it is at super locked condition or locked condition and the key is inserted in the key cylinder 92 of the door turning it in a unlock direction, the key lock lever 28 and shaft 30 respectively at their condition shown in FIG. 3 start to rotate clockwise and the lock operation detection switch 69 detects a unlock operation according to rotary displacement of the shaft 30. As shown in FIG. 13, when it is detected, the super-lock-motor 60 of the all lock device is impressed in order to displace the super lock member 62 to its released position shown by imaginary lines of FIG. 7, and continuously the normal-lock-motor 59 is impressed and the output shaft 16 clockwise rotates the inside lock lever 17 bringing it to its unlocked position shown in FIG. 2.

Next, various operations of the portable transmitter 76 will be explained.

When an output signal of the transmitter 76 is received by the receiving portion 77, the lock condition detection switch 68 confirms that the lock device is at its locked condition or unlocked one.

When the lock device is at a unlocked condition, output signal from the transmitter 76 is handled as lock operation signals, the normal-lock-motor 59 of the all lock device is impressed, and the inside lock lever 17 is displaced to its locked position. Continuously, the switches 71 to 75 confirm the operative conditions of the super lock. When all switches have turned off, the super-lock-motor 60 of the all lock device is impressed in order to rotate the output shaft 61 and displace the super lock member 62 to its super lock position. If even one of these switches 71 to 75 has turned on, the alarm buzzer 80 sounds making the driver known of the abnormal situation and preventing current from flowing into the super-lock-motor 60.

On the contrary, the switches 71 to 75 confirm operative conditions of the super lock. When all switches have turned off, current is impressed to the super-lock-motor 60 in order to rotate it in its locking direction. As a result, when the motor 60 doesn't rotate, it is known that it is already at a super locked condition. Consequently, output signal from the transmitter 76 is handled as a lock releasing signal, current is supplied to the super-lock-motor 60 for rotating it in a releasing direction in order to displace the super lock member 62 to its released position. Then, the normal-lock-motor 59 is impressed and accordingly the inside lock lever 17 is displaced to a unlocked position.

When a lock rotation current rotates the super-lock-motor 60, the super lock member 62 is displaced to its super lock position emitting an operation completion signal to finish the operation.

When the lock device is locked and one or any operative conditions of the super lock is not satisfied, a timer is functioned and alarm sound is sent out. When the receiving portion 77 again receives operative signal from the transmitter 76 within the predetermined time of the timer, the normal-lock-motor 59 changes the inside lock lever 17 to its unlocked position. When the receiving portion 77 fails to receive operative signal, the operation is stopped.

According to the conventional lock device with a super lock, when the lock device suddenly becomes at a super locked condition while driving or running owing to unexpected accident, the door of the car can not open by an operation from the interior of the car making the situation very serious.

On the contrary, according to the lock device with a super lock of the present invention, the central lock switch 81 is unlocked when it is possible to detect the key inserted into the ignition key cylinder at the driver's seat by the switch 71 or to detect the driver in the car, so that releasing current is supplied to the super-lock-motor 60 releasing the super lock. As a result, it becomes possible to open the door from the operation at the car interior.

What is claimed is:

1. A door lock device for a car with a super lock mechanism comprising a lock lever moveable between a locked position and an unlocked position, a super lock member displaceable to a super locked position preventing the lock lever from moving between said locked position and said unlocked position and a released position enabling movement between said locked position and said unlocked position, super-lock-motor means for displacement of said super lock member between said super locked position and said released position, wherein rotation of a door key cylinder by a key in a locking direction actuates said super-lock-motor means to move the super lock member to said super lock position, wherein, rotation of the door key cylinder by the key in the unlocking direction actuates the super-lock-motor means to move the super lock member to the released position, and when said super-lock-motor means is inoperative further rotation of the door key cylinder by the key in the unlocking direction mechanically moves the lock lever into engagement with the super lock member and moves the super lock member to the released position,a first switch of a plurality of switches turned on when a key is inserted into an ignition key cylinder by the seat of a .driver of the car, a second switch of said plurality of switches turned on when a person is recognized within the car, a third switch of said plurality of switches turned on when a door of the car is open, a fourth switch of said plurality of switches turned on when the trunk is open, and the fifth switch of said plurality of switches turned on when a window of the car is open, and an alarm buzzer, said plurality of switches and the alarm buzzer connected to a control circuit of the door lock device, the alarm buzzer being actuated, when any one of said plurality of switches is turned on and the door key cylinder is rotated in a locking direction by the key.

2. A door lock device in accordance with claim 1 wherein said second switch of said plurality of switches is responsive to a driver seated in a driver's seat.

3. A door lock device for a vehicle with a super lock mechanism comprising a lock lever moveable between a locked position and unlocked position by normal-lock-motor means for moving said lock lever, a super lock member displaceable to a super locked position preventing the lock lever from moving between said locked position and said unlocked position and a released position, super-lock-motor means for enabling movement between said locked position and said unlocked position when said super lock member is in the released position, a transmitter independent from the vehicle, and a receiving portion receiving operation signals from the transmitter, wherein when the receiving portion receives operation signals from the transmitter when the lock lever is moved to said unlocked position, the normal-lock-motor means moves the lock lever to said locked position arid the super-lock-motor means moves the super lock member to said super locked position, and wherein, rotation of the door key cylinder by the key in the unlocking direction actuates the super-lock-motor means to move the super lock member to the released position, and when said super-lock-motor means is inoperative further rotation of the door key cylinder by the key in the unlocking direction mechanically moves the lock lever into engagement with the super lock member and moves the super lock member to the released position, a first switch of a plurality of switches turned on when a key is inserted into an ignition key cylinder by the seat of a driver of the vehicle, a second switch of said plurality of switches turned on when a person is recognized within the vehicle, a third switch of said plurality of switches turned on when a door of the vehicle is open, a fourth switch of said plurality of switches tuned on when a trunk of the vehicle is open, and the fifth switch of said plurality of switches turned on when a window of the vehicle is open, and an alarm buzzer, said plurality of switches and the alarm buzzer connected to a control circuit of the door lock device, wherein when any of said plurality of switches is turned on and the receiving portion has received operation signals from the transmitter, the alarm buzzer is actuated.

4. A door lock device in accordance with claim 3 wherein said second switch of said plurality of switches is responsive to a driver seated in a driver's seat.

5. A door lock device for a car with a super lock mechanism comprising a lock lever moveable between a locked position and an unlocked position, a super lock member displaceable to a super locked position preventing the lock lever from moving between said locked position and said unlocked position and a released position enabling movement between said locked position and said unlocked position, super-lock-motor means for displacement of said super lock member between said super locked position and said released position, wherein rotation of a door key cylinder by a key in a locking direction actuates said super-lock-motor means to move the super lock member to said super lock position, a first switch of a plurality of switches turned on when a key is inserted into an ignition key cylinder by the seat of a driver of the car, a second switch of said plurality of switches turned on when a person is recognized within the car, a third switch of said plurality of switches turned on when a door of the car is open, a fourth switch of said plurality of switches turned on when a trunk of the car is open, and the fifth switch of said plurality of switches turned on when a window of the car is open, and an alarm buzzer, said plurality of switches and the alarm buzzer connected to a control circuit of the door lock device, wherein when any one of said plurality of switches is turned on and the door key cylinder is rotated in a locking direction, the super lock member remains in said released position.

6. A door lock device as claimed in claim 5, wherein when any one of said plurality of switches is turned on and the door key cylinder is rotated in a locking direction, the alarm buzzer is actuated.

7. A door lock device in accordance with claim 5 wherein said second switch of said plurality of switches is responsive to a driver seated in a driver's seat.

8. A door lock device for a vehicle with a super lock mechanism comprising a lock lever moveable between a locked position and unlocked position by normal-lock-motor means for moving the lock lever, a super lock member displaceable to a super locked position preventing the lock lever from moving between said locked position and said unlocked position and a released position, super-lock-motor means for enabling movement between said locked position and said unlocked position when said super lock member in the released position, a transmitter independent from the vehicle, and a receiving portion receiving operation signals from the transmitter, wherein when the receiving portion receives operation signals from the transmitter when the lock lever is placed in said unlocked position, the normal-lock-motor means moves the lock lever to said locked position and the super-lock-motor means moves the super lock member to said super locked position, a first switch of a plurality of switches turned on when a key is inserted into an ignition key cylinder by the seat of a driver of the vehicle, a second switch of said plurality of switches turned on when a person is recognized within the vehicle, a third switch of said plurality of switches turned on when a door of the vehicle is open, a fourth switch of said plurality of switches turned on when a trunk of the vehicle is open, and a fifth switch of said plurality of switches turned on when a window of the vehicle is open, and an alarm buzzer, said plurality of switches and said alarm buzzer connected to a control circuit of the door lock device, wherein when any one of said plurality of switches is turned on and the receiving portion receives operation signals from the transmitter, the super lock member remains in said released position.

9. A door lock device as claimed in claim 8, wherein when any one of said plurality of switches is turned on and the receiving portion receives operation signals from the transmitter, the alarm buzzer is actuated.

10. A door lock device in accordance with claim 8 wherein said second switch of said plurality of switches is responsive to a driver seated in a drivers seat.

11. A door lock device for a vehicle with a super lock mechanism comprising a lock lever moveable between a locked position and an unlocked position, normal-lock-motor means for moving said lock lever between said locked position and said unlocked position, a super lock member displaceable to a super locked position preventing the lock lever from moving between said locked position and said unlocked position and a released position enabling the lock lever to move between said locked position and said unlocked position, and super-lock-motor means for enabling the super lock member to move between said super locked position and said released position, wherein when a door key cylinder rotates in a locking direction, the super-lock-motor moves the super lock member to said super lock position, a central lock switch operating the normal-lock-motor means of said lock lever of each door of said vehicle, a first switch turned on when a key is inserted into the ignition key cylinder at a seat of a driver of the vehicle, and a second switch turned on when a person is recognized within the car, the super-lock-motor means being actuated to move the super lock member to the released position when either the first switch or the second switch is turned on and the central lock switch is unlocked.

12. A door lock device in accordance with claim 11 wherein said second switch of said plurality of switches is responsive to a driver seated in a driver's seat.

* * * * *